US010617604B2

(12) United States Patent
Klaus et al.

(10) Patent No.: US 10,617,604 B2
(45) Date of Patent: Apr. 14, 2020

(54) END CAP FOR CARTRIDGE-SHAPED RECEPTACLE

(71) Applicant: B. BRAUN AVITUM AG, Melsungen (DE)

(72) Inventors: Dinah Klaus, Münster (DE); Matthias Wesseler, Melle (DE); Johannes Kathol, Willisau (CH)

(73) Assignee: B. Braun Avitum AG, Melsungen (DE)

( * ) Notice: Subject to any disclaimer, the term of this patent is extended or adjusted under 35 U.S.C. 154(b) by 330 days.

(21) Appl. No.: 15/686,856

(22) Filed: Aug. 25, 2017

(65) Prior Publication Data

US 2018/0055733 A1 Mar. 1, 2018

(30) Foreign Application Priority Data

Aug. 30, 2016 (DE) ..... 10 2016 116 098

(51) Int. Cl.
*A61J 1/18* (2006.01)
*A61J 1/14* (2006.01)
*B65D 41/32* (2006.01)

(52) U.S. Cl.
CPC ..... *A61J 1/18* (2013.01); *A61J 1/1412* (2013.01); *A61J 1/1425* (2015.05); *A61J 1/1475* (2013.01); *B65D 41/325* (2013.01)

(58) Field of Classification Search
CPC .... A61J 1/18; A61J 1/20; A61J 1/1412; A61J 1/1425; A61J 1/1437; A61J 1/1443;
(Continued)

(56) References Cited

U.S. PATENT DOCUMENTS 3,994,412 A 11/1976 Difiglio
4,015,400 A 4/1977 Choksi et al.
(Continued)

FOREIGN PATENT DOCUMENTS

DE 2645563 A1 9/1977
DE 4029832 A1 3/1992
(Continued)

OTHER PUBLICATIONS

German Search Report for German Application No. 10 2016 116 098.9, dated Apr. 28, 2017 with translation, 12 Pages.
(Continued)

*Primary Examiner* — Philip R Wiest
(74) *Attorney, Agent, or Firm* — RatnerPrestia

(57) ABSTRACT

An end cap which is prepared for being fastened, especially attached, to an especially pipe socket-type connecting port of a cartridge-shaped receptacle and in a mounted state serves for sealing the connecting port, including a top surface portion, a shell surface portion being connected, especially perpendicularly and cylindrically, to the top surface portion, and a flange portion connected to the shell surface portion, the flange portion including and/or forming a sealing portion, by which the end cap can be fixed and sealed to the cartridge-shaped receptacle, and a predetermined breaking/tearing portion, at which the end cap tears and/or breaks in a predefined manner when the end cap is removed from the cartridge-shaped receptacle.

11 Claims, 3 Drawing Sheets

(58) Field of Classification Search
CPC ..... A61J 1/1475; A61J 1/1471; A61J 1/1487; B65D 41/325
See application file for complete search history.

(56) References Cited

U.S. PATENT DOCUMENTS

| | | | | |
|---|---|---|---|---|
| 5,807,345 | A | 9/1998 | Grabenkort | |
| 9,676,525 | B2 * | 6/2017 | Greiner-Perth .... | B65D 47/2068 |
| 2005/0051572 | A1 * | 3/2005 | Vogel ..... | A61J 1/18 222/83 |
| 2011/0022024 | A1 | 1/2011 | Brandenburger et al. | |

FOREIGN PATENT DOCUMENTS

| | | | |
|---|---|---|---|
| DE | 4217352 | A1 | 4/1993 |
| DE | 10223560 | A1 | 12/2003 |
| DE | 102012109199 | A1 | 4/2014 |
| EP | 0532835 | A2 | 3/1993 |
| EP | 2712603 | A1 | 4/2014 |
| WO | 9726941 | A1 | 7/1997 |
| WO | 2015145902 | A1 | 10/2015 |

OTHER PUBLICATIONS

European Search Report for European Application No. 17187367.2, dated Feb. 9, 2018 with translation, 10 pages.

* cited by examiner

END CAP FOR CARTRIDGE-SHAPED RECEPTACLE

CROSS REFERENCE TO RELATED APPLICATIONS

This application claims priority to German application DE 10 2016 116 098.9 filed Aug. 30, 2016, the contents of such application being incorporated by reference herein.

FIELD OF THE INVENTION

The invention relates to an end cap prepared for being fastened to an, especially pipe socket-type, connecting port/connector of a cartridge-shaped receptacle/a cartridge and in a mounted state serves for sealing the connecting port, comprising a top surface portion of especially round/circular shape, a shell surface portion being adjacent, especially perpendicularly and cylindrically, to the top surface portion, and an, especially annular, flange portion adjacent to the shell portion. Moreover, the invention relates to a cartridge-shaped receptacle/a cartridge for an extracorporeal blood treatment machine which includes at least one, especially pipe socket-type, connecting port forming a fluid inlet and/or a fluid outlet and at least one end cap for sealing the at least one connecting port.

BACKGROUND OF THE INVENTION

The therapeutic success of the most diverse dialysis methods is based, inter alia, on the use of different buffer substances with the aid of which a modified acid-base metabolism of patients suffering from renal insufficiency can be corrected. Against the background that the acid-base metabolism cannot be corrected by diffusion during dialysis, frequently a supply of buffer substances is required. For balancing the gradient between acids and bases especially bicarbonate and, respectively, a bicarbonate buffer solution is suited. The bicarbonate buffer solution is produced for hemodialysis preferably immediately before or during the treatment. Accordingly, a receptacle, especially a cartridge-shaped receptacle/a cartridge containing a bicarbonate concentrate powder is connected to a fluid source, for example a water source, the water flowing through the receptacle dissolving the bicarbonate concentrate powder present in the receptacle and flushing the latter into the dialysis solution.

The known cartridge-shaped receptacles/cartridges basically include a fluid inlet connecting port/connector and a fluid outlet connecting port/connector to each of which a fluid inlet line and a fluid outlet line can be attached. The connecting ports/connectors basically consist of short pipe sections or pipe nozzles axially protruding from the receptacle. In order to be able to ensure or guarantee a durability of bicarbonate cartridges which is worldwide uniform, i.e. independent of temperature, pressure and air humidity, it is known from prior art to attach or screw end caps having a sealing function onto the pipe nozzle-type connecting ports/connectors.

DESCRIPTION OF THE RELATED ART

For example, from EP 0 532 835 B1 a cartridge-shaped receptacle/a cartridge is known comprising a connecting port onto which an end cap having a sealing function is put or attached, respectively. Furthermore, DE 42 17 352 C2 discloses an end cap which is screwed onto a connecting port of a cartridge-shaped receptacle/a cartridge and includes a silicone packing. The end caps of EP 0 532 835 B1 and DE 42 17 352 C2 have the drawback, however, that they are not sealed to the receptacle/cartridge/connecting port. Hence a user cannot find out whether the receptacle/cartridge is still originally sealed, especially has a tamper-evident closure, or was opened already. The cap of DE 42 17 352 C2 in addition exhibits drawbacks in handling, as it has to be screwed onto the connecting port and cannot be attached thereto.

In order to ensure that the cartridge-shaped receptacle/the cartridge is still originally sealed or has a tamper-evident closure, it is basically known from prior art to seal the pipe nozzle-type connecting port of the receptacle/cartridge with a film/film seal. If, however, merely a film for sealing is arranged on the connecting port, this entails the drawback that said film can be damaged or pierced during storage and/or transport. Therefore, it is suggested in WO 97/26941 A1, for example, to additionally screw an end cap onto a film-sealed connecting port for protecting the film seal. However, when opening the receptacle/cartridge this causes an additional handling step and requires additional disposal of the film.

In U.S. Pat. No. 5,807,345 A, a cap for closing and sealing a syringe is disclosed which includes a flange portion positively accommodated in a sleeve portion of the syringe. When the cap of U.S. Pat. No. 5,807,345 A is removed from the syringe, however, and subsequently fastened or attached thereto again, a user is not able to find out from outside and also when removing the cap again that the latter had been removed already before and thus no tamper-evident closure is provided any more.

In DE 26 45 563 A1 an end cap having a secured tear opening is disclosed that at a shell portion of the end cap includes a predetermined breaking/tearing portion at which the end cap is intended to tear/break in a defined manner when removing the same. Providing a predetermined breaking/tearing portion being perforated/including a perforation on a shell portion of the end cap has the drawback, however, that a user cannot find out at first sight whether the seal is still unbroken or whether the cartridge was opened already. Moreover, the end cap of DE 26 45 563 A1 bears the risk that, when the end cap is put onto the connecting port again for disposal and especially for preventing the residual solution provided in the concentrate receptacle from dripping, said end cap is no longer sufficiently fixed to the connecting port and comes off during transport and/or during storage.

SUMMARY OF THE INVENTION

Against this background, it is an object of the present invention to avoid or at least alleviate the drawbacks from prior art. Especially, an end cap for an, especially cartridge-shaped, receptacle/a cartridge is to be provided which can be easily handled and provides a sealed tamper-evident closure adapted to be quickly and easily inspected by a user. In particular, it is an object of the invention to permit immediate visual inspection of the tamper-evident closure. In addition, a repeated arrangement of the end cap for the purpose of disposal is intended to be improved.

This object is achieved by an end cap and a cartridge-shaped receptacle/a cartridge according to the independent claims. Advantageous embodiments and developments are claimed in the subclaims and/or will be explained hereinafter.

The invention initially relates to an end cap, especially having a shock-absorbing effect, which is prepared for being fastened, especially attached, to an, especially pipe socket/nozzle-type, connecting port/connector of a cartridge-shaped receptacle/a cartridge and in a mounted state serves for sealing/closing the connecting port, comprising a cover portion/top surface portion especially in a round/circular shape, a shell (surface) portion being adjacent to the cover portion, especially extending perpendicularly and cylindrically from the cover portion, and an, especially annular, flange portion being adjacent to the shell portion, the flange portion in particular extending perpendicularly and radially outwardly away from an end side of the shell portion, wherein the flange portion includes and/or forms a sealing portion, by which the end cap can be fixed and sealed to the cartridge-shaped receptacle/the cartridge, and a predetermined breaking/tearing portion, at which the end cap tears and/or breaks in a predefined manner when the end cap is removed from the cartridge-shaped receptacle/the cartridge.

In other words, according to aspects of the invention an end cap in the form of a cylinder recessed in the form of a blind hole is provided which at its open end includes a flange portion extending radially, preferably perpendicularly, outwardly especially from the shell portion. The end cap may be easily arranged by being attached to a connecting port of a cartridge-shaped receptacle/a cartridge containing powder particles such as bicarbonate, sodium chloride or the like, so that especially a closed, i.e. heat-sealed and/or packed, cartridge system may be formed with the aid of or by the end cap/cap/cover cap according to aspects of the invention. The end cap further has a protective function for the connecting portion and prevents the latter from being damaged in any way.

The flange portion includes a sealing portion, especially a seal ring, via which the end cap can be sealed and fastened/fixed to the cartridge-shaped receptacle/the cartridge and, respectively, the connecting port. The sealing portion serves, in other words, for fastening and sealing the end cap on the cartridge-shaped receptacle/the cartridge/connecting port. In the state of the end cap fixed/fastened to the cartridge-shaped receptacle/the cartridge, a tamper-evident closure is provided in this way. The sealing portion is preferably arranged on a radial outside of the flange portion. The sealing portion/seal ring may be crenellated according to aspects of the invention.

When the flange portion includes and/or forms, apart from/additionally to the sealing portion a predetermined breaking/tearing portion at which the end cap tears and/or breaks in a predetermined manner when the end cap is removed from the cartridge-shaped receptacle/the cartridge, a user can immediately recognize when looking at the radially outwardly extending flange portion, i.e. at first sight, whether the cartridge-shaped receptacle/the cartridge is still originally sealed or was opened already. In other words, an aspect of the invention resides in the fact that a predetermined breaking/tearing portion at which the end cap is intended to tear or break in a predefined manner, when it is removed from the cartridge-shaped receptacle/the cartridge, is provided at the flange portion. In this way, a user can find out more easily and quickly than with a predetermined breaking/tearing portion provided at a shell/a shell portion whether or not the cartridge-shaped receptacle/the cartridge is still originally sealed, which is accompanied by an improved handling of the receptacle/cartridge. Especially when axially viewing the cartridge-shaped receptacle/the cartridge, easier identification of a present tamper-evident closure is facilitated.

Advantageously, the predetermined breaking/tearing portion of the flange portion is provided at a transition area to the shell portion and is formed as at least one predetermined breaking point and/or a predetermined tearing line at which the end cap tears and/or breaks when removing the end cap from the cartridge-shaped receptacle/the cartridge so that the sealing portion of the end cap remains on the cartridge-shaped receptacle/the cartridge and the remaining end cap consisting of shell and cover portion is detachable from the cartridge-shaped receptacle/the cartridge.

The predetermined breaking/tearing portion may thus be designed as a continuous peripheral/circumferential, especially perforated or pierced, predetermined tearing line or as a predetermined breaking point/a plurality of predetermined breaking points. Especially the predetermined breaking/tearing portion constitutes a weakened portion of the flange portion. This is in general achieved in that less material/a lower wall thickness/perforations/recesses/holes or the like are provided on the predetermined breaking/tearing portion. This has the effect that, when a force is applied for removing the end cap, a defined tear/breakage occurs at a predetermined position on the flange portion and, at the same time, the sealing portion remains to be fixed/fastened on the cartridge-shaped receptacle/the cartridge.

In accordance with the invention, thus a force required for tearing/removing the sealing portion from the cartridge-shaped receptacle/a cartridge is greater than a force which is required for tearing/breaking the end cap at the predetermined breaking/tearing portion. Hence a user knows that the end cap can or should break or tear at a predetermined position only, which largely facilitates visual inspection. Against this background, a user also may conclude that the cartridge-shaped receptacle/a cartridge was properly sealed before opening the same, when the seal ring/sealing portion is still present to be tightly fastened/fixed to the cartridge-shaped receptacle/the cartridge/connecting portion after opening the receptacle.

One advantageous embodiment is characterized in that the sealing portion has a plurality of recesses, namely such that it consists of a peripheral/circumferential seal ring portion and a plurality of, especially triangular, connecting portions, the connecting portions being locally connected to the shell portion and the predetermined breaking/tearing portion being formed by the plurality of local connections.

According to a preferred embodiment in accordance with the invention, thus a peripheral/circumferential ring portion/seal ring portion is fixed/fastened to the cartridge-shaped receptacle/the cartridge/connecting port. Said ring portion is located at a radial outside of the flange portion. From the ring portion plural, especially eight, triangular connecting portions extend toward the shell portion and locally contact the shell portion by a point of the triangle. In this way, plural, especially eight, local connections are formed between the flange portion and the shell portion. The entirety of the local connections of this embodiment constitutes the predetermined breaking/tearing portion according to aspects of the invention. If the end cap of this embodiment is rotated and/or it is pulled, the local connections will tear/break so that the end cap, now consisting of the shell portion and the cover portion, can be removed and the sealing portion will remain on the cartridge-shaped receptacle/the cartridge/connecting port.

Moreover, the predetermined breaking/tearing portion may be provided in the form of a perforated, especially pierced, peripheral/circumferential predetermined tearing line, especially predetermined perforation tearing line.

According to a second preferred embodiment in accordance with the invention, the flange portion is thus formed from the shell portion to its radial outside as a continuous solid material portion and includes a perforated predetermined tearing line merely at or close to a transition area to the shell portion. In other words, the predetermined breaking/tearing portion according to this embodiment is formed by plural closely stringed together/adjacent perforations/small holes.

Furthermore, according to aspects of the invention, the predetermined breaking/tearing portion may also be formed continuously unpierced or unperforated, for example by reduced material thickness. Such embodiment entails an improved sealing or sealing effect. The predetermined breaking/tearing portion in each case—as in all embodiments of the present invention—constitutes a weak spot at least in portions on the flange portion of the end cap, however.

It may further be provided that both the flange portion and the shell portion have at least one predetermined breaking/tearing portion and the predetermined breaking/tearing portions of the flange portion and of the shell portion are circumferentially merging. Thus, according to this embodiment, a circumferential predetermined tearing line is provided which alternately merges from the flange portion to the shell portion and vice versa. Further preferred, exactly one predetermined breaking/tearing portion is provided on the flange portion which, after a rotation by 180°, merges into a predetermined breaking/tearing portion on the shell portion. After rotation by 180° of the predetermined breaking/tearing portion on the shell portion, again a transition to the predetermined breaking/tearing portion occurs on the flange portion.

It is advantageous when the end cap is an attachment cap and the sealing portion of the flange portion is received in a seat/seating provided at the cartridge-shaped receptacle/the cartridge, especially by crimping or press-fitting, and/or is fastened to the cartridge-shaped receptacle/the cartridge by form fit.

Due to the fact that the end cap is in the form of an attachment cap, no complicated screwing of the same is required. Handling is facilitated in this way. If the sealing portion, which is especially in the form of a break seal, is received/fastened in a seat provided on the cartridge-shaped receptacle/the cartridge/connecting port by form fit, fixing/sealing of the end cap to the cartridge-shaped receptacle/the cartridge can be implemented, preferably fully automatically, in one single process step. Of preference, the end cap is fastened to the cartridge-shaped receptacle/the cartridge within the scope of a fully automated production plant. Accordingly, in a first step the end cap is attached to the connecting port. In a second step, the sealing portion is forced/pressed/reformed/engaged/welded/clipped into the seat with the aid of a pressing tool/a reforming/curling tool, especially a crimping tool, and is thus accommodated in the seat by form fit. Moreover, the form fit may be brought about by reforming portions of the cartridge-shaped receptacle/the cartridge/connecting port and by clamping of the sealing portion effectuated in this way.

It is noted that although, according to aspects of the invention, a form fitting connection of the sealing portion to the seat provided on the cartridge-shaped receptacle/the cartridge by crimping or press-fitting is preferred, also an adhesive/bonded connection by welding or a force and form fitting connection by riveting may be provided, however. Especially, one out of plural imaginable types of connection is to be chosen which is adapted to fasten and seal the end cap appropriately to the cartridge-shaped receptacle/the cartridge/connecting port and protects the end cap against slipping off or detaching from the connecting port.

Moreover, it is useful when the end cap includes at least one sealing element for sealing the connecting port of the cartridge-shaped receptacle at an inside of the end cap on the cover portion and/or the shell portion.

In order to be able to provide the closed cartridge system of the present invention, it is essential to ensure appropriate sealing to the outside so that the durability of the cartridge-shaped receptacle/the cartridge is independent of the climate zone in which it is used. In the case of increased ambient temperature, pressure and air humidity, the carbonate value of bicarbonate cartridges may increase more quickly, which would be accompanied by a reduced durability. Therefore, the sealing is a fundamental aspect of the present invention.

According to aspects of the invention, the sealing is realized by sealing elements formed integrally/in one material on an inside of the end cap. In other words, the sealing elements are formed by an appropriate constructional design and, respectively, material selection of the end cap according to aspects of the invention. Preferably, at least one circumferential sealing lip is provided on the shell portion at the end cap inside which can be structurally materialized by increasing the wall thickness of the shell portion in portions, for example. However, there may also be provided two, three, four or more circumferential sealing lips or sealing elements on the shell portion.

In accordance with the invention, different configurations of sealing elements are imaginable. What is important, however, is that the sealing elements are manufactured in one piece/in one material, especially by injection molding, in one process step with the end cap and are integrally formed with an inside of the end cap. In particular, functional elasticity and material elasticity of the sealing elements are to be produced and provided by the geometry thereof and the material used.

A sealing effect may also be realized, according to aspects of the invention, by a plug-type central part integrally formed on the cover portion which is configured integrally and by one single material with the end cap and is equally provided on the inside of the end cap. According to aspects of the invention, the end cap is intended to seal the connecting port merely by a plug/attachment connection and thus without using any thread.

Advantageously, on the cover portion at an end cap inside at least one, preferably at least two, web-type projections are provided which in a mounted state of the end cap constitute a bearing face portion of the end cap on an end face of the, especially pipe socket/nozzle-type, connecting port.

The radial plastic webs provided on the cover portion of the end cap and thus lying on top, which preferably have a narrow/elongate design and are formed integrally/in one single material with the end cap, help to provide proper shock absorption and thus to protect the connecting port of the cartridge-shaped receptacle/a cartridge in a definitely improved way. It has turned out in test series that by the fact that merely individual web-type projections of the end cap contact the end face of the connecting port the protective effect and the shock absorption of the end cap are definitely improved and thus any damage of the connecting port is prevented.

It is further advantageous when the shell portion of the end cap includes at least one wing-shaped protruding handle portion on an outside of the end cap for improved handling of the end cap.

Wing-shaped projecting or protruding handle portions enhance usability and thus removal of the cap/end cap. There may be provided one or more wing-shaped handle portions. Apart from wing-shaped projections, also cross-shaped projections are imaginable according to aspects of the invention. Moreover, a cover or shell outside of the end cap may be corrugated or rubber-coated so as to improve the grip of the cap.

It is useful when the end cap is made from elastic plastic material, especially an elastomer or a thermoplastic elastomer, and/or is in the form of a one-piece and single-material plastic component manufactured by injection molding.

Elastic material properties of the end cap are required in various respects according to aspects of the invention and thus equally constitute a central aspect of the present invention. Especially, this helps to improve the tightness of the end cap, to obtain optimum protection of the connecting port as well as to improve a shock-absorbing effect of the end cap.

The entire end cap is preferably manufactured by injection molding in one single process step as a single-material and one-piece or integral plastic component.

In accordance with another aspect of the present invention, additionally a label may be provided/attached in portions on the end cap and in portions on the cartridge-shaped receptacle/the cartridge/connecting port by which additional sealing is performed and a present tamper-evident closure becomes visible at first sight.

Moreover, the invention relates to a cartridge-shaped receptacle/a cartridge for an extracorporeal blood treatment machine including at least one, especially pipe nozzle-type, connecting port/connector forming a fluid inlet and/or a fluid outlet, and to at least one end cap as afore-described for closing and sealing the at least one connecting port.

BRIEF DESCRIPTION OF THE DRAWINGS

The invention is best understood from the following detailed description when read in connection with the accompanying drawings. Included in the drawings are the following figures.

DETAILED DESCRIPTION OF THE PREFERRED EMBODIMENTS

Figure 1:
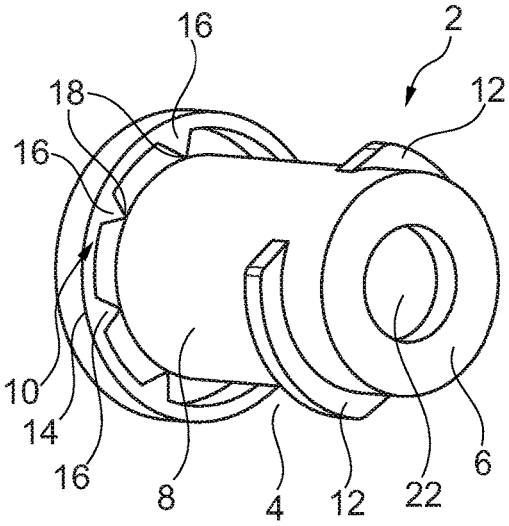
FIG. 1 shows a perspective view of an end cap outside of the end cap according to aspects of the invention.

The Figures are merely schematic and exclusively serve for the comprehension of the invention. Like elements are provided with like reference numerals. The features of the individual embodiments/exemplary configurations may be interchanged.

In FIG. 1 a perspective view of an end cap 2, especially an end cap outside 4, is shown. The end cap 2 is composed of a circular cover portion 6, a shell portion 8 perpendicularly and cylindrically adjacent to the cover portion 6 and a flange portion 10 outwardly adjacent radially perpendicularly to the shell portion 8 and being completely circumferential in the peripheral direction. At an upper portion of the shell portion 8 two wing-shaped handle portions 12 are provided which are spaced apart from each other, are facing each other and are arranged to respectively cover about a third or quarter of a circle. The two wing-shaped handle portions 12 project/protrude with respect to the shell portion 8 and form a respective pitch circle projection.

The flange portion 10 in this preferred embodiment according to aspects of the invention consists of a sealing portion/seal ring 14 and a plurality of (eight) triangular connecting portions 16, each being formed integrally with a triangular side to contact the seal ring 14, being tapered toward the shell portion 8 with a respective opposite point of the triangle and being evenly spread about the periphery of the flange portion. The (eight) points of the triangle establish local connections/point connections 18 to the shell portion 8. By the entirety of the (eight) local connections 18 the predetermined breaking/tearing portion according to aspects of the invention is realized in the present embodiment. The predetermined breaking/tearing portion is thus located on the flange portion 10. The cover portion 6 has a central blind hole 22 on the outside 4 of the end cap.

Figure 2:
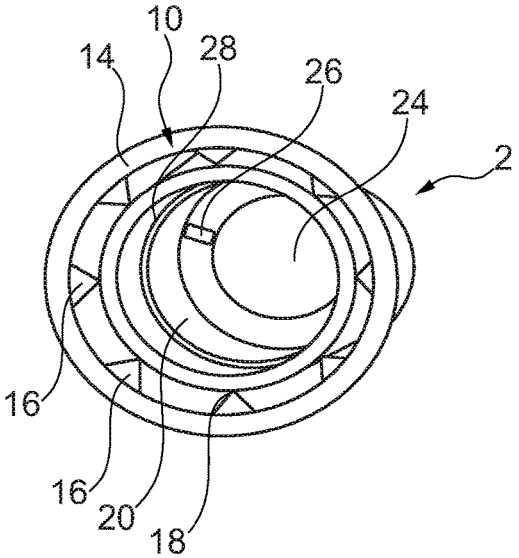
FIG. 2 shows a perspective view of an end cap inside of the end cap according to aspects of the invention.

FIG. 2 illustrates a perspective view of the end cap 2, especially of an inside 20 of the end cap. In this case, it becomes initially clear that the blind hole 22 shown in FIG. 1 is formed as a plug-type projection 24 at the end cap inside 20. The cover portion 6 includes, on the inside 20 of the end cap, two web portions/web-type projections 26 only one of which is visible in FIG. 2, however. The web portions 26 are narrow and elongate and extend from a radial outside of the cover portion 6 toward the plug-type projection 24. The web portions 26 are formed to project/protrude with respect to the cover portion 6. The second invisible web portion 26 is opposed to the first web portion 26. Thus, the two web portions 26 are evenly distributed along the periphery of the cover portion 6.

On a central portion of the shell portion 8 a peripheral sealing portion 28 configured in the kind of a sealing lip is provided on the end cap inside 20. However, for improving the sealing effect there may also be provided two, three, four or more peripheral sealing portions 28.

The end cap 2 is manufactured integrally and by one single material from elastic plastic material by injection molding in one process step.

Figure 3:
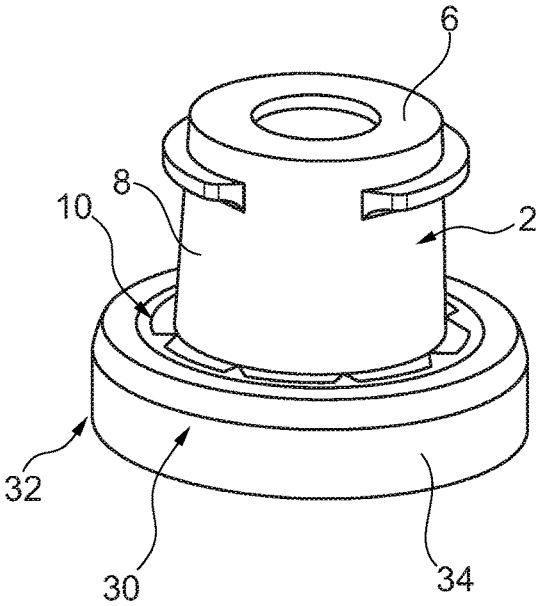
FIG. 3 shows a perspective view of an end cap according to aspects of the invention fixed to a connecting port of a cartridge-shaped receptacle/a cartridge.

FIG. 3 illustrates a perspective view of an end cap 2 fixed to a connecting port 30 of a cartridge-shaped receptacle/a cartridge. The connecting port 30 in this case has a base-type portion 34 and a pipe socket-type portion 36. The end cap 2 is attached to the pipe nozzle-type portion 36 of the connecting port 30 and is accommodated via its seal ring 14 in a seat 38 of the base-type portion 34 and, respectively, is fastened to the base-type portion 34 of the connecting port 30.

In the state as shown in FIG. 3 in which the end cap 2 is fastened to the connecting port 30 in an originally sealed state, a user immediately recognizes, especially when axially viewing the end cap 2 in FIG. 3, that point connections 18 are provided between the connecting portions 16 and the shell portion 8. Thus, an immediate visual inspection as to whether or not (no longer) a tamper-evident closure is (still) provided is enabled, according to aspects of the invention, especially by this preferred embodiment.

Figure 4:
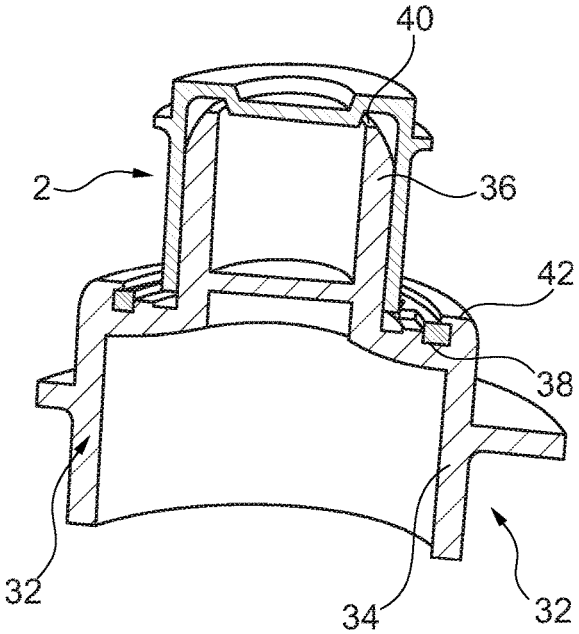
FIG. 4 shows a perspective sectional view of the end cap according to aspects of the invention fixed to the connecting port of the cartridge-shaped receptacle/the cartridge.

FIG. 4 illustrates a perspective sectional view of the end cap 2 fixed to the connecting port 30 of the cartridge-shaped receptacle/the cartridge. The web portions 26 in this case rest on an end face 40 of the pipe nozzle-type portion 36 of the connecting port 30. The plug-type projection 24 protrudes into the opening of the connecting port 30 and seals the connecting port 30 to the outside. Thus, according to the preferred embodiment of the present invention, no film is provided for sealing the connecting port 30. Moreover, the sealing portion 28 fulfils an additional sealing function and is fully adjacent to an outside of the pipe nozzle-type portion 36 of the connecting port 30. According to aspects of the invention, thus preferably a double sealing is provided by the sealing portion on the one hand and by the plug-type projection 24 on the other hand. However, it is also imaginable to provide further sealing portions 28 which are arranged in parallel to and in the axial direction offset against the shown sealing portion 28 and equally provide a fully circumferential sealing.

According to this preferred embodiment, on the one hand the seal ring 14 can be pressed into the annular seat 38. Accordingly, an outer annular portion 42 of the base-type portion 34 is elastically urged radially outwardly and bounces back radially inwardly, after the seal ring has been engaged or clipped on, so that the seal ring is thus accommodated in the annular seat 38 by form fit. On the other hand, according to this preferred embodiment the seal ring 14 may also be provided to be inserted into the annular seat without applying force and subsequently fixation by form fit may be provided to be realized by radially inwardly reforming or bending the outer annular portion 42.

Figure 5:
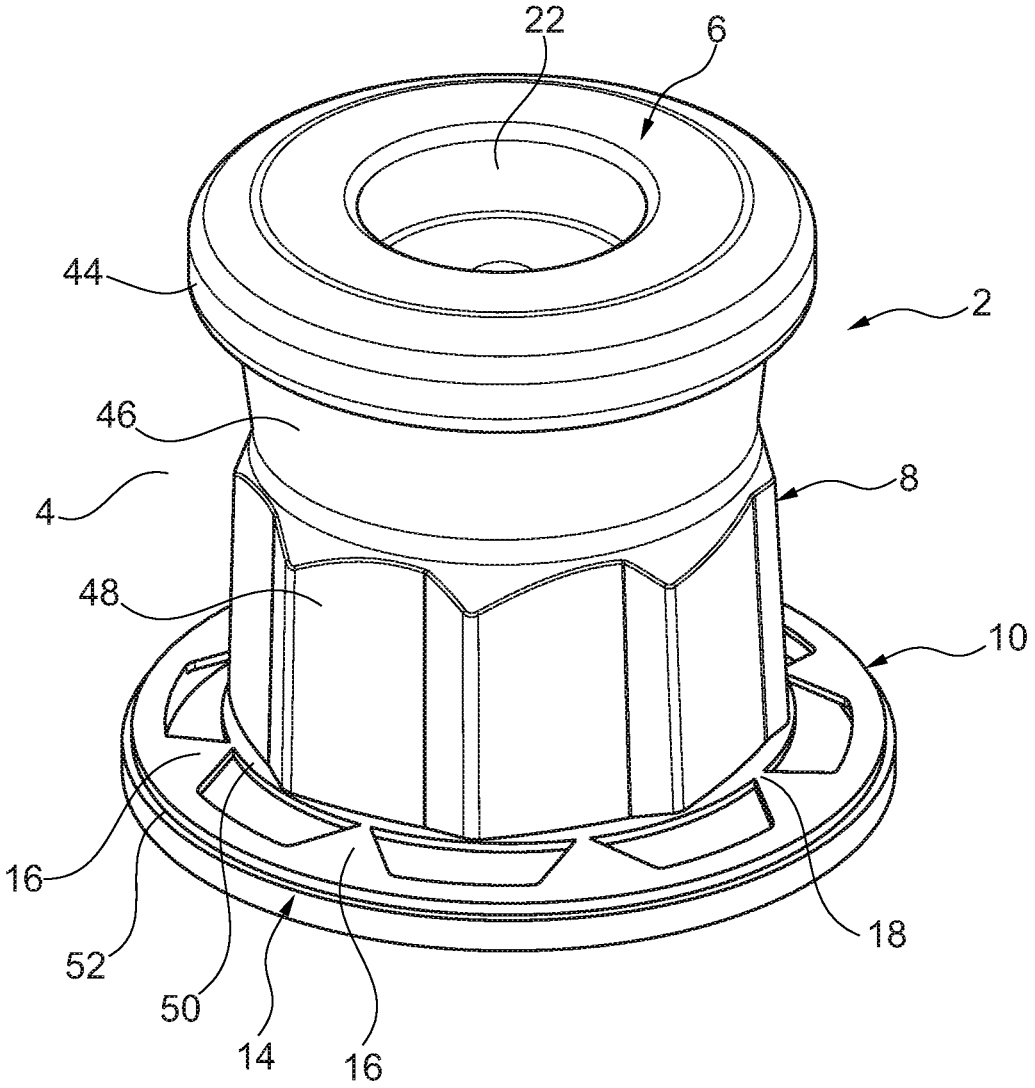
FIG. 5 shows a perspective view of a second embodiment of the end cap according to aspects of the invention.
Figure 6:
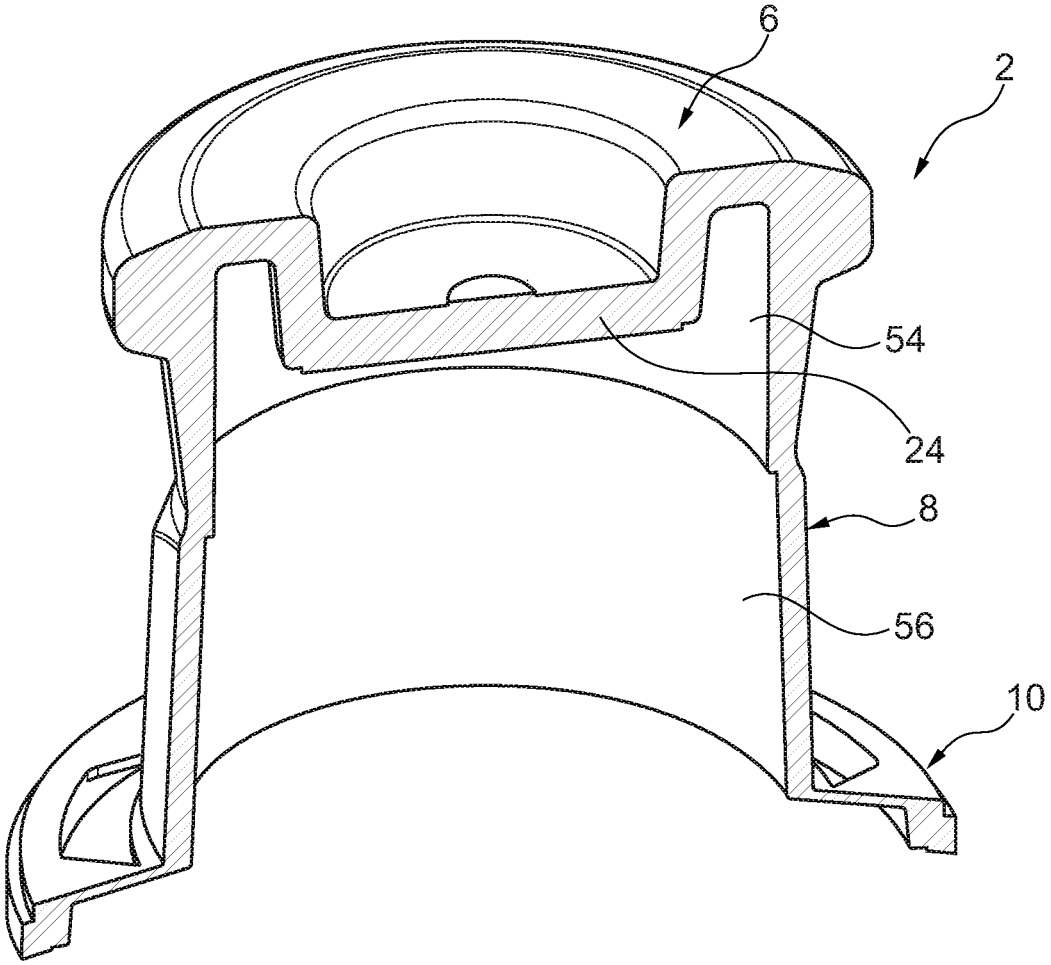
FIG. 6 shows a perspective sectional view of the end cap of FIG. 5.

A second embodiment of the end cap 2 according to aspects of the invention is shown in FIG. 5 and FIG. 6. As can be inferred from FIG. 5, the cover portion 6 in this embodiment likewise includes a blind hole 22. Rounded edges between the cover portion 6 and the blind hole 22 as well as between the cover portion 6 and the shell portion 8 improve handling of the end cap 2.

The cover portion 6 merges at the outside 4 of the end cap into a radially outwardly projecting upper external portion 44 of the shell portion 8. A radially recessed central external portion 46 of the shell portion 8 is adjacent to the upper external portion 44. In this embodiment, the upper radially projecting external portion 44 thus can be easily seized by a user, thus facilitating/improving removal of the end cap 2 from a cartridge. For the rest, a spanner flat (polygonal profile) may be provided on the external portion 46 for better torque pickup.

A lower corrugated external portion 48 of the shell portion 8 is connected to the central external portion 44. The lower corrugated external portion 48 is angular, for example octagonal, and has concavely inwardly curved side portions. Hence a rough corrugation is given which helps to facilitate rotation of the end cap 2 and thus opening of the end cap 2.

The flange portion 10 of FIG. 5 includes, adjacent to the corrugated external portion 48, a first radially outwardly projecting flange portion 50 which approximately constitutes a periphery around the corrugated external portion 48. Triangular connecting portions 16 are adjacent to the first radially outwardly projecting flange portion 50. A peripheral predetermined breaking/tearing portion according to aspects of the invention is formed between the first radially outwardly projecting flange portion 50 and the triangular connecting portions 16. The sealing portion 14 adjacent to the triangular connecting portions 16 has an upper peripheral and recessed corner portion 52 in which, for example, the annular portion 42 shown in FIG. 4 may engage.

It is evident from FIG. 6 that in this second embodiment of the end cap 2 a sealing is performed, on the one hand, by the plug-type projection 24 and, on the other hand, by a peripheral upper internal sealing portion 54 extending from the cover portion 6 to a lower internal portion 56 of the shell portion 8.

The invention claimed is:

1. An end cap prepared for being fastened to a connecting port of a cartridge-shaped receptacle and in a mounted state seals the connecting port, the end cap comprising:

a round top surface portion;

a shell surface portion adjacent to the top surface portion, the shell surface portion extending cylindrically and perpendicularly from the top surface portion; and a flange portion adjacent to the shell surface portion, the flange portion extending perpendicularly and radially outwardly away from an end side of the shell surface portion, the flange portion comprises a sealing portion and a tamper indicator portion, the sealing portion configured to fix and seal the end cap to the cartridge-shaped receptacle and the separation portion is configured to at least one of tear or break in a predefined manner when the end cap is removed from the cartridge-shaped receptacle.

2. The end cap according to claim 1, wherein the tamper indicator portion of the flange portion is provided at a transition area to the shell surface portion and is formed as at least one of one or more predetermined breaking points at which the end cap breaks or as a predetermined tearing line at which the end cap tears when removing the end cap from the cartridge-shaped receptacle so that the sealing portion of the end cap remains on the cartridge-shaped receptacle and the remaining end cap includes the shell surface portion and the top surface portion, but not the sealing portion, and is detachable from the cartridge-shaped receptacle.

3. The end cap according to claim 1, wherein the sealing portion comprises a plurality of recesses such that the sealing portion includes a circumferential sealing ring portion and a plurality of connecting portions, the connecting portions being locally connected to the shell surface portion and the tamper indicator portion being formed by the plurality of local connections.

4. The end cap according to claim 1, wherein the tamper indicator portion is in the form of a perforated circumferential predetermined tearing line.

5. The end cap according to claim 1, wherein the end cap is in the form of an attachment cap and the sealing portion of the flange portion is at least one of accommodated in a seating provided on the cartridge-shaped receptacle or fastened to the cartridge-shaped receptacle by form fit.

6. The end cap according to claim 1, wherein the end cap comprises at least one sealing element for sealing the connecting port of the cartridge-shaped receptacle at at least one of an inside of the end cap on the top surface portion or on the shell surface portion.

7. The end cap according to claim 1, further comprising at least one web-type projection on the top surface portion at an inside of the end cap, said projection constituting, in a mounted state of the end cap, a bearing face portion of the end cap on an end face of the connecting port.

8. The end cap according to claim 1, wherein the shell surface portion of the end cap comprises at least one wing-shaped projecting handle portion at an outside of the end cap.

9. The end cap according to claim 1, wherein the end cap is at least one of made from elastic plastic material or in the form of a one-piece and single-material plastic component manufactured by injection molding.

10. The end cap according to claim 1, wherein the tamper indicator portion is a predetermined breaking/tearing portion.

11. A cartridge-shaped receptacle for an extracorporeal blood treatment machine that includes at least one connecting port forming at least one of a fluid inlet or a fluid outlet, the cartridge-shaped receptacle comprising at least one end cap according to claim 1 for closing and sealing the at least one connecting port.

* * * * *